US005918440A

United States Patent [19]

Focke et al.

[11] Patent Number: 5,918,440

[45] Date of Patent: Jul. 6, 1999

[54] DEVICE FOR MANUFACTURING PACKETS FROM THIN PACKAGING MATERIAL

[75] Inventors: Heinz Focke, Verden; Hans-Jürgen Bretthauer, Bremen, both of Germany

[73] Assignee: Focke & Co. (GmbH & Co.), Verden, Germany

[21] Appl. No.: 08/959,169

[22] Filed: Oct. 28, 1997

[30] Foreign Application Priority Data

Oct. 31, 1996 [DE] Germany ..... 196 44 079

[51] Int. Cl.[6] ..... B65B 11/28

[52] U.S. Cl. ..... 53/234; 53/228; 53/389.3

[58] Field of Search ..... 53/575, 563, 228, 53/234, 389.3, 389.4

[56] References Cited

U.S. PATENT DOCUMENTS

| | | | |
|---|---|---|---|
| 3,735,767 | 5/1973 | Kruse et al. | 131/25 |
| 4,603,534 | 8/1986 | Focke | 53/231 |
| 4,852,225 | 8/1989 | Focke et al. | 53/575 |
| 5,771,666 | 6/1998 | Bertuzzi et al. | 53/466 |

FOREIGN PATENT DOCUMENTS

| | | |
|---|---|---|
| 15386 | 9/1980 | European Pat. Off. . |
| 425903 | 10/1990 | European Pat. Off. . |
| 698552 | 7/1995 | European Pat. Off. . |
| 2244533 | 4/1974 | Germany . |
| 2410587 | 9/1975 | Germany . |
| 3545884 | 7/1987 | Germany . |
| 3731063 | 3/1988 | Germany . |

*Primary Examiner*—Linda Johnson
*Assistant Examiner*—Matthew Luby
*Attorney, Agent, or Firm*—Sughrue, Mion, Zinn, Macpeak & Seas, PLLC

[57] ABSTRACT

In the manufacture of (cigarette) packets, especially of the soft-case type, the handling of critical, namely thin, packaging material on powerful packaging machines is problematic. A holding disc (26), to the peripheral surface (40) of which the blank (12) is adjacent, and a transverse supporting and conveying member (34) which is attached to the holding disc (26) and grasps a front end of the blank (12) by means of suction air, serve to lead blanks (12) to a rotary folding unit (10) and to take the blanks (12) by means of mandrels (11).

6 Claims, 4 Drawing Sheets

DEVICE FOR MANUFACTURING PACKETS FROM THIN PACKAGING MATERIAL

BACKGROUND OF THE INVENTION

The invention relates to a device for manufacturing packets from foldable (thin) packaging material, especially paper, film or the like, blanks being separated in succession from a web of the packaging material and led into a folding assembly, especially a rotary folding unit, to wrap an object.

The invention is concerned in particular with problems in the manufacture of soft-case packets for cigarettes. The packaging machines used for this work at high capacity and thus high speed of the members moved. This makes more difficult the handling particularly of thin critical packaging material, such as paper, film, tin foil etc. Leading blanks towards the folding assembly, especially towards a rotary folding unit requires special measures, particularly when the rotary folding unit circulates constantly.

For leading the web of packaging material or the detached blank, it is not possible to use those conveying members which grasp the material web or the blank over its whole surface or at least at both longitudinal edges. Only in the end region of the conveying can the material web or the blank be grasped by a conveyor, at the most on one side and in an edge region.

SUMMARY OF THE INVENTION

The object underlying the invention is to guarantee the transporting of material webs or blanks in conjunction with packaging machines even at high conveying speeds and where the packaging material is thin, such that the packaging material or the blanks may be led in free of folds and in the correct position.

In achieving this object, the device according to the invention is characterised in that a free end of the material web and/or of the blank separated from the material web may be grasped and transported by a holding and conveying member extending over the width of the material web or blank in order to be led into the folding assembly.

According to the invention, the particularly critical edge region of the material web or the blank, lying at the front in the conveying direction, may be grasped by a separate conveying member and fixed preferably along its whole width during transport. A finger- or rod-shaped supporting and conveying member serves this purpose and grasps the front edge region of the material web or blank, especially by suction. The supporting and conveying member is moved in synchronization with at least one continuous conveyor for the material web or blank. The supporting and conveying member, extending transversely to the conveying direction or transversely to the material web, is expediently attached to the conveyor for the material web or blank itself.

The invention can be used with particular advantage on a rotary folding unit on which hollow folding mandrels, projecting on one side along the circumference, are attached, onto which mandrels the blanks are to be laid. A rotary folding unit of this kind is known and usual in particular for the manufacture of (soft) pouches for cigarettes. According to the invention, the supporting and conveying member passes with a web end or a front region of a blank between two successive folding mandrels, such that, as a result of the movement of the folding mandrels, the blank is picked up and drawn off the supporting and conveying member. The latter then returns to its initial position in order to pick up a new following blank. The rotary folding unit is expediently configured in accordance with EP 0 226 872, the supporting and conveying member being attached to a (suction) disc, aligned axially parallel, for leading in the material web or the blank. However, the supporting and conveying member can also be connected to other continuous conveyors for the material web or blank, for example to a band conveyor.

Further details of the invention are explained more fully below with the aid of an embodiment, given by way of example and shown in the drawings. These show:

DESCRIPTION OF PREFERRED EMBODIMENTS

Figure 1:
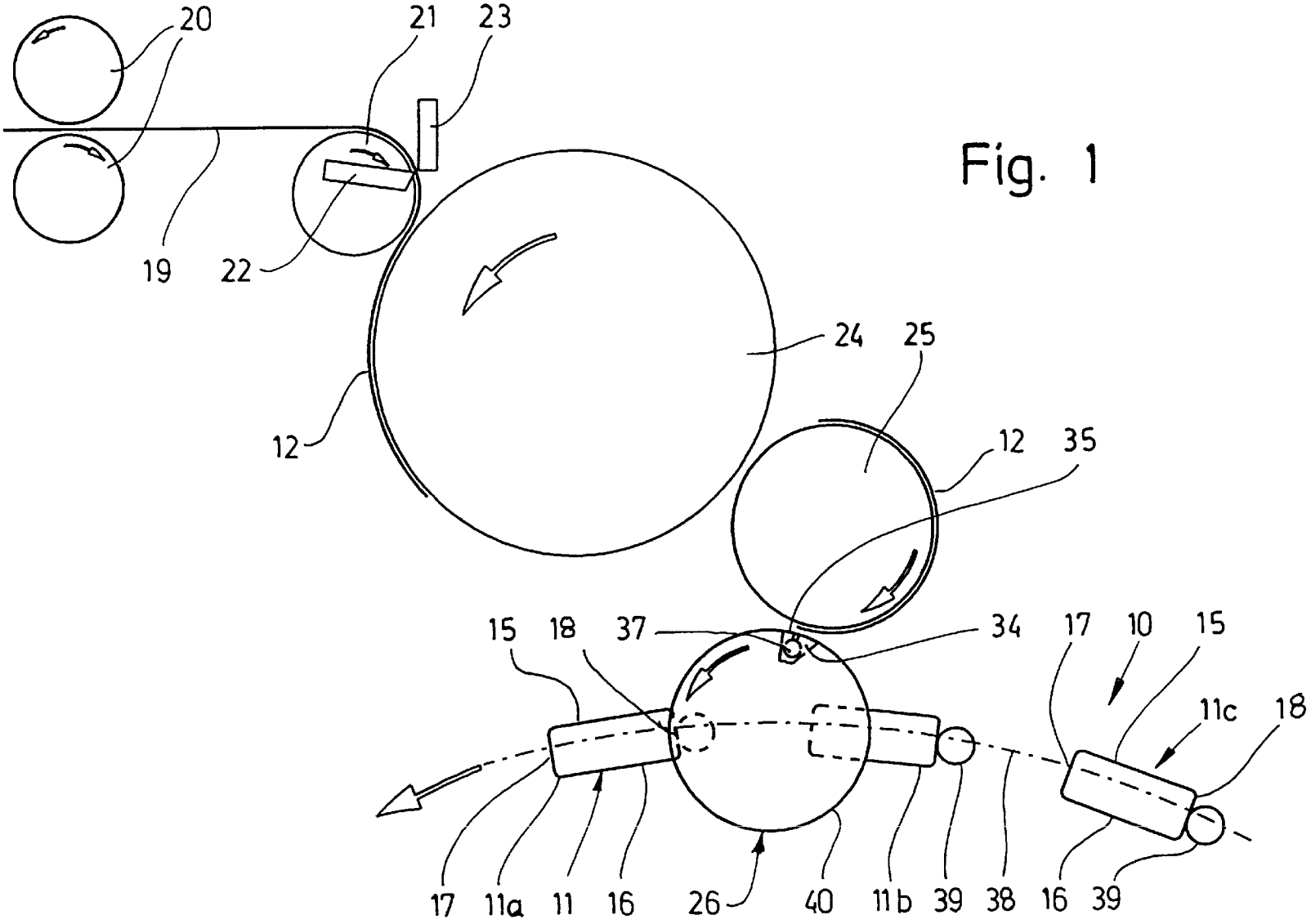
FIG. 1 a detail of a rotary folding unit with conveying members for the material web and blanks, in a greatly simplified side view, FIG. 2 a partial region of the rotary folding unit with conveying members for leading in blanks, in radial section and on an enlarged scale, FIG. 3 to FIG. 7 individual movement stations of the rotary folding unit as a material web or a blank is led in, in diagrammatic side view.

In the drawings the handling of thin packaging material, such as paper, tin foil, film is shown as a preferred embodiment, given by way of example, in conjunction with a rotary folding unit 10 for manufacturing (cigarette) packets of the soft-case type. The rotary folding unit 10 is only shown in part, i.e. the folding mandrels 11 arranged distributed along the circumference and at equal distances from one another. For the rest, the rotary folding unit can be advantageously configured in accordance with EP 0 226 872.

Figure 2:
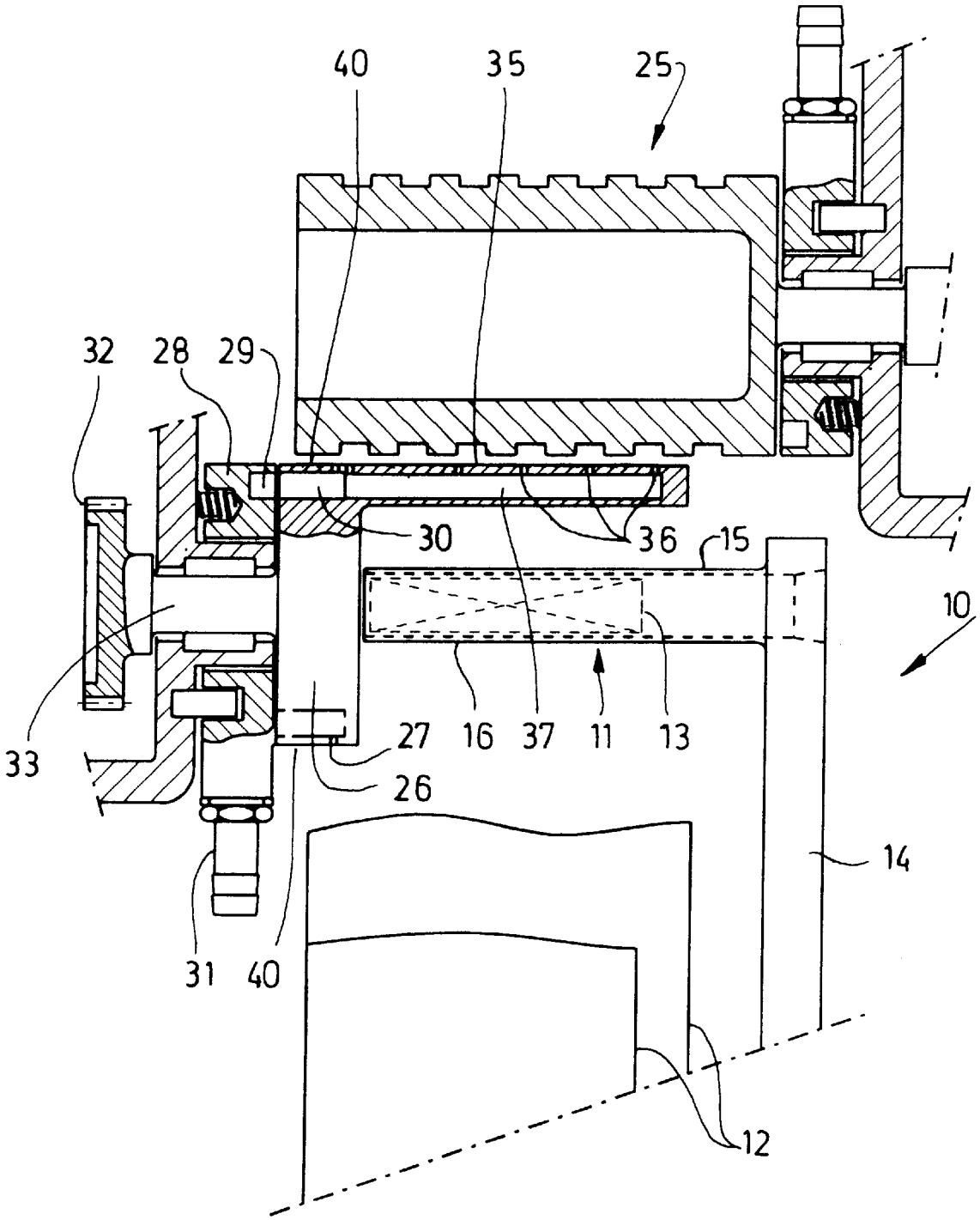

Folding mandrels 11 are known aids for folding blanks 12 in the production of wrappings for a group of cigarettes 13. The folding mandrels 11 are configured as hollow bodies made of thin-walled material and open on both sides. The folding mandrels 11 are attached on one side, projecting in a formation parallel to the axis, to a carrier of the rotary folding unit 10, in the present case to a revolving disc 14 (FIG. 2). The relative position of the folding mandrels 11 is chosen to be such that large-surface outer walls 15 point radially outwards and corresponding inner walls 16, lying opposite, point inwards. Aligned approximately radially are a narrow front wall 17 and a correspondingly configured rear wall 18. The blanks 12 for an inner wrapping (paper/tin foil) and for a pouch (predominantly paper) are folded in succession on the outer side of the folding mandrels 11.

Figure 7:
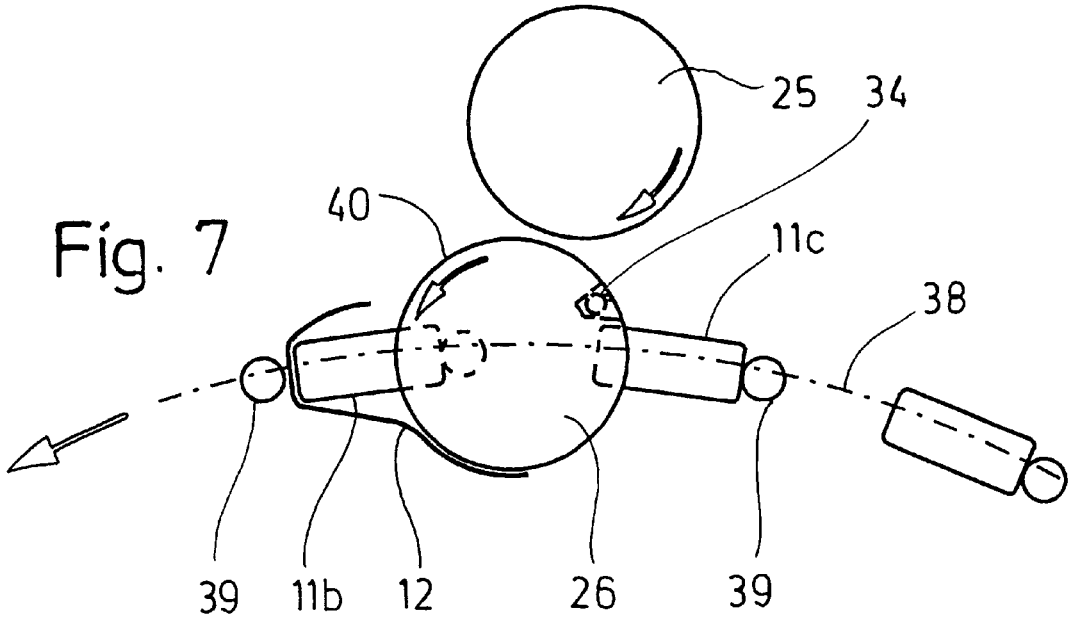

What is critical is the way in which the blanks 12 are led to the folding mandrels 11 during the continuous movement of the rotary folding unit 10. The problems arise first from the lack of dimensional stability of the packaging material and secondly from the high working speeds of the packaging machine. The object is to lead the blank 12 separated from a material web 19 into the region between two folding mandrels 11*a* and 11*b* succeeding one another in the direction of the periphery, i.e. into the gap formed between said mandrels, and hold the blank ready. The following folding mandrel 11*b* grasps the blank 12 with the front wall 17 lying at the front in the conveying direction and picks up the blank 12 making a U-shaped fold (FIG. 7).

The material web is led by preliminary rollers 20—coming from a reel, not shown—to a cutting station. This consists here of a (continuously) circulating cutter wheel 21 with a parting blade 22. The latter acts together with a stationary counter blade 23, such that the material web 19 adjacent to the circumference of the cutter wheel 21 is severed, forming blank 12.

In the region of the severance station, the material web 19 or the blank 12 is transferred by the cutter wheel, which is equipped with suction bore holes, to an intermediate roller 24, likewise equipped with suction bore holes. This intermediate roller accelerates the blank 12 and passes it on to a transfer roller 25. From the latter, the blank 12 is taken by the actual stand-by member which holds the blank 12 in readiness in an arched, cylindrical shape for being taken by a folding mandrel 11. The blank assembly, described to this extent, corresponds preferably to EP 226 872 in respect of further details.

The member for holding a blank 12 in readiness in the region of the rotary folding unit 10 consists of a continuously circulating endless conveyor, namely of a holding disc 26. The latter is positioned fixed beside the rotary folding unit 10 or beside the movement path of the folding mandrels 11. As is clear from FIG. 2, the holding disc 26 is positioned on the side lying opposite the revolving disc 14 directly beside the folding mandrels 12.

The blank 11 is passed from the transfer roller 25 to the circumference of the holding disc 26, in such a way that an edge strip of the blank 12, extending in the conveying direction, is adjacent to the circumference of the holding disc 26. The holding disc is provided with radially aligned suction bore holes 27 for fixing the blank 12, which holes open out on a cylindrical outer peripheral surface 40 for the blank 12. The blank 12 obtains a partially cylindrical shape through the holding disc 26. During an operating phase, the folding mandrel 11*b* receiving the blank 12 is covered by this blank 12.

Negative pressure is applied to the holding disc 26 via a unit which is known in principle. The holding disc 26 itself is adjacent to a fixed supply disc 28. The latter is provided on the side turned towards the holding disc 26 with suction grooves 29 in the form of circular arcs. Connecting bores 30 of the holding disc 26 join onto these grooves intermittently. The axially parallel connecting bores 30 join on to the suction bore holes 27. The segment-shaped suction groove 29 is connected to a suction line 31 leading to a negative pressure source.

The holding disc is driven, rotating, via a driving wheel 32 and a shaft 33.

To the holding disc 26 there is attached at least one member which extends transversely to the conveying direction or transversely to the blank 12. This is a supporting and conveying member 34 which grasps an end or edge region, lying at the front in the transporting direction, of the blank 12 (or a material web 19) and preferably fixes same through suction.

In the present case, the supporting and conveying member 34 is a long stretched-out, finger- or rod-shaped hollow body which extends over the full width of the blank 12. In FIG. 2, two blanks 12 of different width are shown symbolically, namely a broader blank 12, made of paper or tin foil as an inner wrapping and a blank of smaller width and made of paper to form the (outer) pouch of the packet. The blanks adjoin the supporting and conveying member 34 in their full width.

The supporting and conveying member 34 is so configured that it forms an outer, preferably arched bearing surface 35 for the blank 12. In the region of this bearing surface 35, a number of suction bore holes 36, arranged in a row the one beside the other, open out. The end region of the blank is held on the bearing surface 35 by these suction bore holes. The suction bore holes 36 lead to a common channel 37 which extends in the longitudinal direction of the supporting and conveying member 34. The channel 37 is connected to one of the connecting bores 30 in the holding disc 26, such that suction air is applied to the supporting and conveying member 34.

The supporting and conveying member 34 is attached to the holding disc 26 protruding or overhanging at one side. The bearing surface 35 lies flush with the peripheral surface 40 of the holding disc 26.

The holding disc 26 is positioned in the centre of the movement path 38 of the folding mandrels 11. Outside the region of the rotary folding unit 10, the holding disc 26 takes a blank 12 from the transfer roller 25. The relative position is chosen to be such that in the moment in which a blank 12 is transferred, the supporting and conveying member 34 is facing the transfer roller 25 and an initial region of the blank 12 is located adjacent thereto. Controlling the suction air, namely by evacuating the air from suction bore holes and applying them, guarantees that the blank 12 is taken by the holding disc 26 and the supporting and conveying member 34 and then conveyed through the continued rotation of the holding disc 26 into the movement region of the folding mandrels 11.

Figure 3:
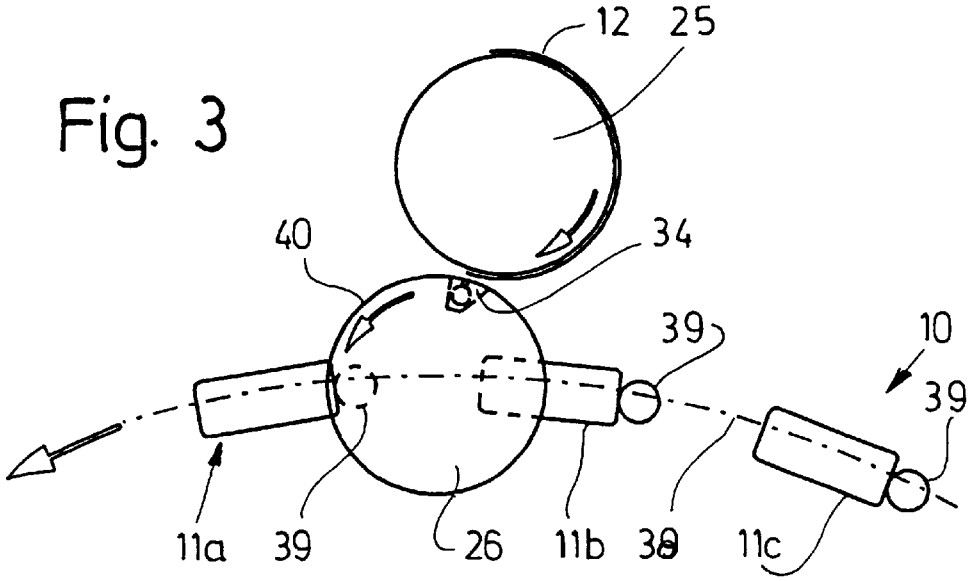
Figure 4:
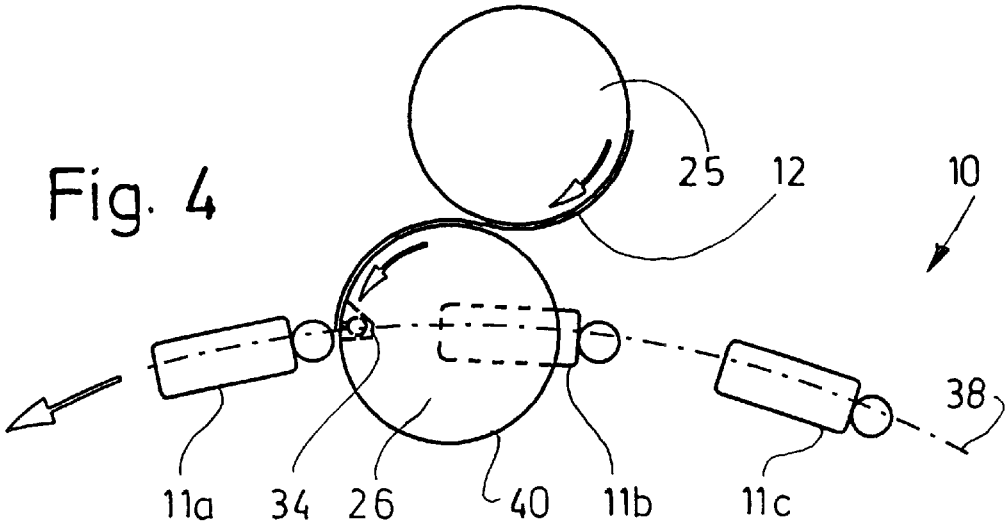
Figure 5:
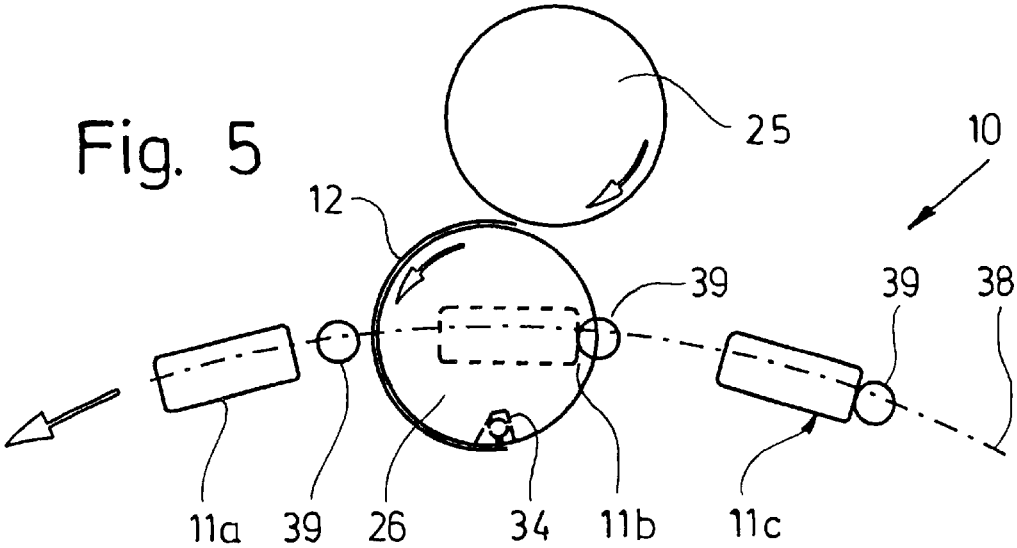
Figure 6:
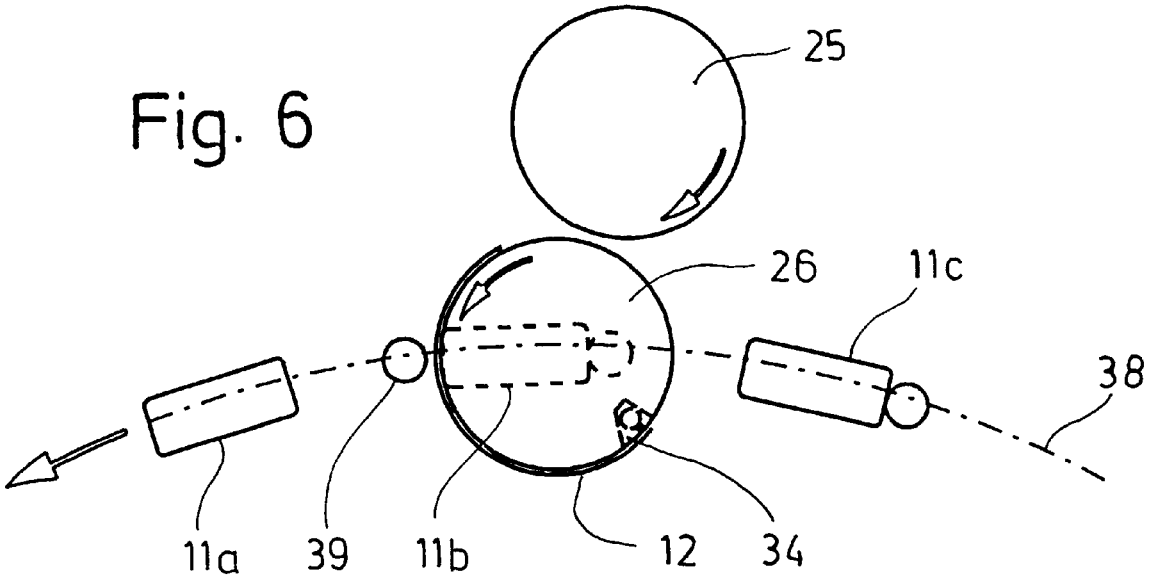

The different phases of movement are shown in FIG. 3 to FIG. 7. In FIG. 3, a position analogous to FIG. 1 can be recognized. One pressing member 39, is associated with each folding mandrel 11, e.g. a roller which circulates with the rotary folding unit 10. In its initial position, the transverse pressing member 39 lies on the rear side or rear wall 18 of the folding mandrel 11*a* which lies in front of it in the direction of movement. In its further course of movement, namely once a blank 12 has been taken by a folding mandrel 11*b,* the pressing member 39 is moved against the front wall 17 of this folding mandrel 11*b,* with the result that the blank 12 is fixed here (FIG. 7).

The holding disc 26, and with it the supporting and conveying member 34, are driven in a special way, namely with a special characteristic movement curve in dependence on the rhythm of the machine. This means that, during a conveying phase of the blank 12 as per FIG. 3 and FIG. 4, the holding disc 26 is driven at the same circumferential speed as the transfer roller 25. This constant speed is maintained into the position according to FIG. 6. In this position, the blank 12 is taken by the folding mandrel 11*b*. During a short phase, the holding disc 26, and with it the blank 12, stands still in order to guarantee the taking over process. Thereafter, the holding disc 26 is accelerated and so moved that the supporting and conveying member 34 is moved between two successive folding mandrels, namely between folding mandrel 11*b,* which has taken the blank 12, and the following folding mandrel 11*c*. The further characteristic movement curve of the holding disc is so formed that the supporting and conveying member 34 comes into the position according to FIG. 3 in the moment when the next blank 12 following it is held ready in the manner shown, namely with a front edge region to be received by the supporting and conveying member 34.

The particular reciprocal action between the leading in member with a supporting and conveying member 34 configured as a finger or an arm, on the one hand, and the continuously circulating folding mandrels 11, consists in the fact that, because of the direction of rotation of the holding disc 26, the supporting and conveying member 34, once it has received a blank 12, is moved essentially in the movement direction of the folding mandrels 11, then plunges into the rotary folding unit (10) in a radial direction and is moved back in an opposite direction inside same. The supporting and conveying member 34 is moved past the front side and rear side of one and the same folding mandrel 11*b* taking the blank 12.

The device can alternately be so designed that instead of the holding disc 26, another (continuous) conveying member is used for the blank 12. (Suction) bands can be used here. The supporting and conveying member 34 is attached in this case to the conveying member or to the bands. It is, furthermore, conceivable that the supporting and conveying member 34 is moved, separately from additional members guiding the blank 12, by a separate transmission along a matched path.

What is claimed is:

1. A device for manufacturing packs made of foldable packaging material, and having means for separating pack blanks (12) in succession from a material web (19) of the packaging material, and for feeding the separated blanks into a rotatable folding unit (10) for the purpose of wrapping an object, wherein:

a) the rotatable folding unit (10) has a rotary axis and a plurality of folding mandrels (11) which project from one side thereof, and which have outer sides upon which the blanks (12) are foldable, said mandrels rotating along a circular path of movement;

b) a rotatable holding disc (26) is mounted at a fixed position outside the path of movement of the folding mandrels (11), and is rotated about a rotation axis to convey each blank (12) in a conveying direction to an inner position where the blank is taken up by a moving folding mandrel;

c) the holding disc (26) has an outer peripheral surface (40) which contains first suction bore holes (27), and upon which one lateral edge of each blank lies;

d) attached to and rotating with the rotatable holding disc (26) is a supporting and conveying member (34) which extends parallel to said rotation axis of the holding disc at an outer periphery thereof in such a way that an outwardly directed bearing surface (35) of the holding and conveying member (34) lies in a plane of the outer peripheral surface (40) of the holding disc (26); and e) with the blank (12) lying with its front transverse edge, relative to said conveying direction, on the bearing surface (35) of the holding and conveying member (34), the holding disc (26) and the holding and conveying member (34) convey the blank to said inner position for being taken up by the moving folding mandrel (11).

2. The device according to claim 1, wherein the holding and conveying member (34) conveys, in an approximately radial direction relative to said circular path, the blank (12) from said position outside said circular path to said inner position between successive folding mandrels (11*a* and 11*b*) which move in succession in the rotating direction of the rotatable folding unit, in such a way that parts of the blank (12) extend to both opposite sides of the folding mandrel that takes up the blank (12).

3. The device according to claim 2 wherein negative pressure acts on suction bore holes (36) of the supporting and conveying member (34) to hold the blank (12), the negative pressure from the suction bore holes (36) being released to cancel the holding force at the same moment the blank (12) is taken by a folding mandrel (11) during a short stationary phase of the supporting and conveying member (34).

4. The device according to claim 2, wherein:

the supporting and conveying member (34) is configured as a finger; and said bearing surface (35) is directed outwards for the blank (12), the bearing surface (35) running flush with the outer peripheral surface (40) of the holding disc (26).

5. The device according to claim 2, wherein: a pressing member (39) is associated with each folding mandrel (11) of the rotatable folding unit (10) to exert pressure on and fix a blank (12) to a front wall (17) of the folding mandrel (11) lying forward in the direction of rotation, with the pressing member (39) of a folding mandrel (11) being held against the back of the next preceding folding mandrel (11*a*) in the direction of rotation while the blank (12) is fed between successive folding mandrels (11*a*, 11*b*).

6. The device according to claim 2 wherein the holding disc (26) and the supporting and conveying member (34) are rotated at variable speeds, with a stationary phase during which a blank (12) is taken up by a folding mandrel (11), and with acceleration phases, in such a way that the supporting and conveying member (34) moves through successive folding mandrels (11) to be positioned adjacent to a transfer roller (25) in order to receive a subsequent blank (12).

* * * * *